US006045986A

United States Patent [19]

Mayo et al.

[11] Patent Number: 6,045,986

[45] Date of Patent: Apr. 4, 2000

[54] FORMATION AND PHOTOGRAPHIC USE OF SOLID PARTICLE DYE DISPERSIONS

[75] Inventors: Philip I. Mayo, West Yorkshire; Valerie Millar, Herst, both of United Kingdom; Mark P. Kirk, Carcare, Italy

[73] Assignee: Tulalip Consultoria Commerial Sociedade Unipessoal S.A., Portugal

[21] Appl. No.: 09/080,435

[22] Filed: May 18, 1998

[30] Foreign Application Priority Data

May 20, 1997 [GB] United Kingdom ..... 9710371

[51] Int. Cl.[7] ..... G03C 1/76; G03C 1/825; G03C 1/83

[52] U.S. Cl. ..... 430/510; 430/517; 430/631

[58] Field of Search ..... 430/510, 517, 430/631

[56] References Cited

U.S. PATENT DOCUMENTS

| | | | |
|---|---|---|---|
| 3,560,214 | 2/1971 | Ruda . | |
| 3,985,565 | 10/1976 | Gabrielsen et al. . | |
| 4,092,168 | 5/1978 | Lemahieu et al. . | |
| 4,211,836 | 7/1980 | Yoneyama et al. . | |
| 4,275,145 | 6/1981 | Mikami | 430/377 |
| 4,288,534 | 9/1981 | Lemahieu et al. . | |
| 4,803,150 | 2/1989 | Dickerson et al. . | |
| 4,855,221 | 8/1989 | Factor et al. . | |
| 4,857,446 | 8/1989 | Diehl et al. . | |
| 4,861,700 | 8/1989 | Shuttleworth et al. . | |
| 4,900,652 | 2/1990 | Dickerson et al. . | |
| 4,940,654 | 7/1990 | Diehl et al. | 430/522 |
| 4,948,717 | 8/1990 | Diehl et al. . | |
| 5,028,521 | 7/1991 | Grzeskowiak . | |
| 5,238,798 | 8/1993 | Usami . | |
| 5,238,799 | 8/1993 | Usami et al. | 430/522 |
| 5,300,394 | 4/1994 | Miller et al. . | |
| 5,326,687 | 7/1994 | Texter . | |
| 5,342,744 | 8/1994 | Wariishi . | |
| 5,356,766 | 10/1994 | Idogaki . | |
| 5,385,819 | 1/1995 | Bowman et al. . | |
| 5,468,598 | 11/1995 | Miller et al. . | |
| 5,478,705 | 12/1995 | Czekai et al. . | |
| 5,500,331 | 3/1996 | Czekai et al. . | |
| 5,513,803 | 5/1996 | Czekai et al. . | |
| 5,726,000 | 3/1998 | Nakanishi et al. . | |
| 5,753,390 | 5/1998 | De Roo et al. | 430/3 |

FOREIGN PATENT DOCUMENTS

| | | |
|---|---|---|
| 0 274 723 B1 | 10/1990 | European Pat. Off. . |
| 0 594 973 A1 | 5/1994 | European Pat. Off. . |
| 0 694 590 A1 | 1/1996 | European Pat. Off. . |
| 0 724 191 A1 | 7/1996 | European Pat. Off. . |

*Primary Examiner*—Janet Baxter
*Assistant Examiner*—Amanda C. Walke

[57] ABSTRACT

The present invention provides a method of forming a dispersion of solid particles of a dye in a gelatin medium which includes the steps of milling the solid dye in the present of a glycerophospholipid dispersant in an aqueous medium and diluting the resulting dispersion with an aqueous solution containing a gelatin. In addition, a photographic element is provided comprising a support having coated thereon at least one silver halide emulsion layer and at least one additional gelatin layer that contains a dispersion of solid particles of a dye and a glycerophospholipid dispersant.

18 Claims, No Drawings

FORMATION AND PHOTOGRAPHIC USE OF SOLID PARTICLE DYE DISPERSIONS

FIELD OF THE INVENTION

This invention relates to the use of glycero-phospholipids as dispersing aids in the generation of fine particle dispersions of solid dyes in aqueous media, and to the use of such dispersions in photographic elements.

BACKGROUND

In many types of silver halide photographic element it is necessary to provide one or more dye layers separate from the emulsion layer(s), e.g. for filtering, antihalation or anti-crossover purposes. In most cases it is essential that the dyes are bleached or washed out completely by processing solutions, so that there is no residual stain in the final image. However, it is equally essential that the dyes do not migrate from their intended layer(s) into adjacent emulsion layer(s) during coating or storage of the photographic elements, as this would lead to desensitization of the emulsion(s). Solid particle dye dispersions, and in particular, solid particle dispersions of dyes which are soluble under alkaline pH conditions, but insoluble under neutral or acidic pH conditions, provide an attractive solution to this problem. In such dispersions, the dyes exist as discrete solid particles (typically of the order of 1 mm in size) under neutral or acidic pH conditions, but dissolve in aqueous alkali. Hence, the dyes are in the form of solid particles under normal coating and storage conditions, and cannot migrate from their intended layer, but are readily dissolved out by typical alkaline photographic processing solutions.

A wide variety of dyes have been used in this way, as disclosed for example in U.S. Pat. Nos. 4,092,168; 4,288,534; 4,803,150; 4,900,652; 4,855,221; 4,940,654; 4,857,446; 4,861,700; 5,238,798; 5,238,799; 5,342,744; 5,356,766; EP-A-0594973 and 0694590. In most cases, alkaline solubility of the dyes is ensured by the presence of one or more carboxylic acid substituents. The solid particle dye dispersions may be formed by precipitation techniques, e.g. by controlled acidification of an alkaline solution of the relevant dye, as described in U.S. Pat. No. 3,560,214, EP-A-0724191 and U.S. Pat. No. 5,326,687, but are most commonly formed by grinding or milling the solid dye to the desired particle size in an aqueous medium, then mixing with gelatin or other hydrophillic colloid. In order to achieve a stable dispersion of suitably small particle size which is not prone to settling, aggregation, coagulation or other undesirable changes during storage, it is normal practice to add one or more surfactants or stabilizers before or after the milling process. For example, EP-A-0694590 discloses the use of a poly(ethyleneoxide)/poly(propylene oxide) block copolymer for this purpose and U.S. Pat. No. 5,300,394 discloses the use of a fluorosurfactant.

U.S. Pat. Nos. 5,468,598, 5,478,705, 5,500,331 and 5,513,803 disclose methods and materials relevant to the production of solid particle dispersions for use in imaging media, and provide lists of suitable surfactants. The surfactant/dispersing aid disclosed in the majority of the Examples in these and other prior art patents is an anionic surfactant called Triton X-200 which is supplied by Union Carbide.

Ideally, a surfactant/dispersing aid used for the preparation of solid particle dye dispersions for photographic use should be cheap, readily available, non-toxic, non-polluting, photographically inert, non-foaming, and should expedite the milling process as well as stabilizing the resultant dispersion. None of the materials disclosed in the prior art fulfills all these criteria, and in particular Triton X-200, the most commonly used material, is found to generate excessive amounts of foam during the milling process, and/or requires long milling times. (Milling times of several days are mentioned in the prior art.) Foaming is caused by entrapment of air during the milling process, and, generally speaking, the degree of foaming increases as the milling process becomes more vigorous. The presence of foam reduces the efficiency of the milling, and may prevent attainment of the desired particle size. If the foam is stable, i.e., does not collapse on standing for a prolonged period, the resulting dispersion may be unusable. In theory, the milling time to achieve a given particle size may be reduced by using a more vigorous milling process, but if foaming is induced or exacerbated, the exercise will be self defeating.

A related problem caused by air entrapment is that of bubble formation. Air may become trapped within the system in the form of bubbles dispersed throughout the liquid medium. If these remain stable after milling has ceased, the resulting dispersion clearly cannot be used for coating purposes, especially thin coatings. The bubbles cause voids and streaks in the coatings. Many conventional surfactants are found to give rise to this problem.

There is, therefore, a need for alternative dispersing aids for use in the production of solid particle dye dispersions for photographic use.

Glycerophospholipids, e.g., lecithin, are well-known dispersing and emulsifying agents, particularly in the food, cosmetic and pharmaceutical industries (see, for example, Kirk-Othmer Encyclopedia of Chemical Technology (4th edition), Vol. 15, pp. 192–210). Lecithin also finds use in magnetic recording media as a stabilizer for dispersions of metal oxide particles in hydrophobic organic binders, and as a pigment dispersant in water-based paints, but has not been widely used in photographic media.

U.S. Pat. No. 5,385,819 discloses the use of lecithin in the growth of tabular silver halide grains. JP55-088045 discloses the use of lecithin in the dispersion, in gelatin, of an oil containing a dye precursor.

DE 2,259,566 discloses the use of lecithin to stabilize a dispersion of silica particles in a photographic layer for antistatic or antifriction properties. The silica particles are formed in or reduced to the required particle size prior to mixing with the lecithin. DD 203,161 discloses the use of a lecithin derivative to stabilize a dispersion of carbon black in a phenolic resin binder, the formulation being used as an antihalation backcoat for a photographic element. The dispersion is formed in a non-aqueous system.

SUMMARY OF THE INVENTION

The present invention provides a method of forming a dispersion of solid particles of a dye in a gelatin medium which comprises milling the solid dye in an aqueous medium and diluting the resulting dispersion with an aqueous solution containing a gelatin, characterized in that the milling is carried out in the presence of a glycerophospholipid dispersant.

In another embodiment, a composition is provided comprising a gelatin medium having dispersed therein solid particles of a dye, the composition further comprising a glycerophospholipid dispersant.

In yet another embodiment, a photographic element is provided comprising a support having coated thereon at least one silver halide emulsion layer and at least one additional gelatin layer, the additional gelatin layer comprising a dispersion of solid particles of a dye and a glycerophospholipid dispersant.

DETAILED DESCRIPTION

Glycerophospholipid dispersants suitable for use in the present invention comprise at least one compound represented by the following structural formula:

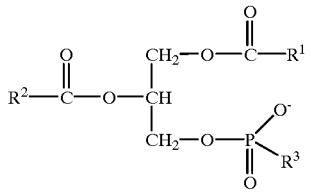

in which:

$R^1$ and $R^2$ independently represent alkyl or alkenyl groups of at least 6 carbon atoms; and $R^3$ represents a quaternized aminoalkoxy group.

Preferably, the groups represented by $R^1$ and $R^2$ are linear alkyl or alkenyl groups of 10 to 30 carbon atoms, most preferably 12 to 24 carbon atoms, the alkenyl groups comprising one or more olefinic bonds. Examples include palmityl, stearyl, oleyl, linoleyl, linolenyl, arachidyl, arachidonyl, etc.

Groups represented by $R^3$ may be regarded as aminoalcohol residues, quaternized by protonation or alkylation of the amino group. Examples of suitable parent aminoalcohols include N,N-dimethylethanolamine, ethanolamine and serine, giving rise to structures for $R^3$ such as:

—O—CH2CH2—N + (CH3)3, (a)

—O—CH2CH2—N + H3, and (b)

—O—CH2CH(CO2H)—N + H3 (c)

Compounds of Formula I in which $R^3$ represents (a), (b) or (c) are known, respectively, as phosphatidylcholine, phosphatidylethanolamine and phosphatidylserine. It should be noted that the names "phosphatidylcholine," "phosphatidylserine," etc., do not denote pure chemical compounds in the normal sense, but embrace mixtures of compounds of Formula I in which the phosphate moiety is uniquely defined, but the acyl residues $R^1CO$ and $R^2CO$ may be derived from a variety of different fatty acids.

Compounds of Formula I may be prepared by standard synthetic routes, but are more conveniently obtained as components of commercially available extracts of animal, vegetable or microbial matter, notably lecithin.

"Lecithin" is the recognized name for glycerophospholipid mixtures extracted from animal, vegetable or microbial sources, the composition varying with the source and method of extraction, but compounds of Formula I are major constituents, together with lesser amounts of analogous compounds in which $R^3$ of Formula I does not comprise a quaternary ammonium functionality, and the negative charge on the phosphate moiety is balanced by hydrogen or a suitable cation. Examples of such compounds include phosphatidylinositol (i.e., $R^3$ represents an inositol residue), phosphatidylglycerol ($R^3$ represents a glycerol residue), and phosphatidic acid ($R^3$ is OH). Other compounds typically present in lecithin include lysophosphatidyl esters (i.e., compounds of Formula I in which $R^1$ or $R^2$ is H), fatty acids, sterols, carbohydrates, triglycerides and glycolipids.

The main commercial sources of lecithin are vegetable oils (e.g., soybean oil, cottonseed oil, sunflower oil, etc.) and animal tissues (e.g., egg or bovine brain). However, egg lecithin and soybean lecithin are by far the most widely available.

Lecithin from any source may be used in the invention, soybean lecithin being preferred solely on the basis of cost and availability. Commercial grades of lecithin suitable for use in the invention include Sternpur PM, Sternpur E and Centrolex P, available from Stem.

The amount of glycerophospholipid dispersant used is typically in the range 1 to 10% w/w of the solid dye, preferably about 5% w/w.

Dyes suitable for use in the invention are readily soluble in aqueous alkali, but insoluble at pH values of about 6.5 or less. In many cases, the desired solubility properties are obtained by incorporation of one or more carboxylic acid groups as substituents. The carboxylic acid group(s) may be attached directly (i.e., conjugated) to the dye chromophore, or present as substituent(s) on side groups. The optimum number of carboxylic acid groups per molecule may vary depending on the structure of the dye, and the nature of any other substituents present. If the dye molecule is relatively small and/or contains one or more polar substituents such as alcohol, phenol or amino groups, and/or does not contain hydrophobic substituents such as long alkyl chains, then zero, one, or at most two, carboxylic acid groups is generally sufficient. On the other hand, if the dye chromophore is particularly hydrophobic (e.g., a rigid, fused aromatic system), or comprises hydrophobic substituents, three or more carboxylic acids may be required in order to obtain the desired solubility properties. Generally speaking, dyes of the latter type are less preferred.

There is no particular restriction on the classes of dyes to be used in the invention, or on the wavelengths of maximum absorption thereof. Depending on the intended use, dyes with narrow or broad absorptions may be used. Mixtures of two or more different dyes may be used, particularly if absorption across a broad range of the spectrum is required. Particularly preferred classes of dye are oxonols, merocyanines and benzylidene dyes, especially oxonols and merocyanines comprising one or more pyrazolone nuclei. Suitable dyes include:

DYE 1

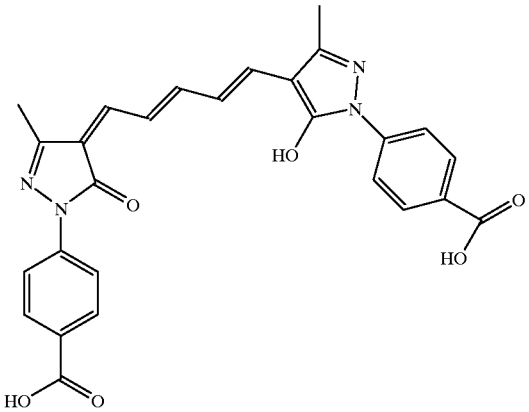

DYE 2

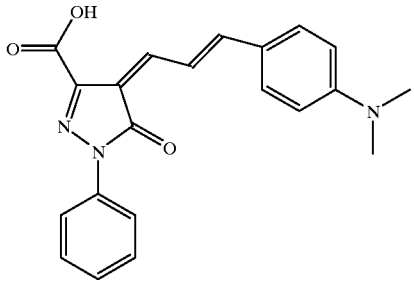

DYE 3

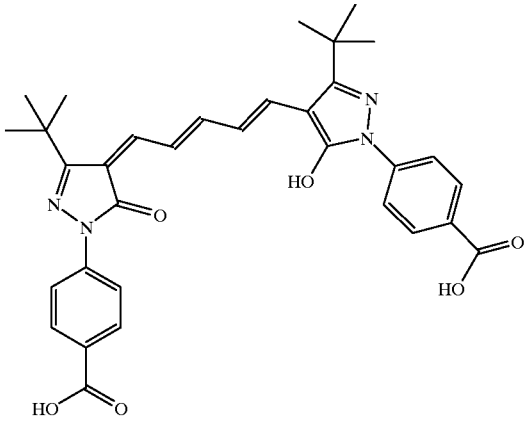

DYE 4

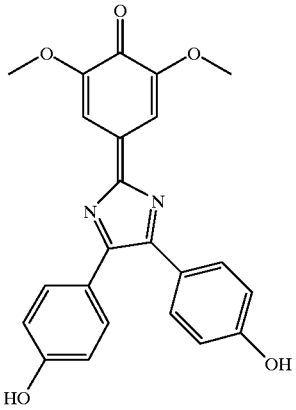

-continued

DYE 5

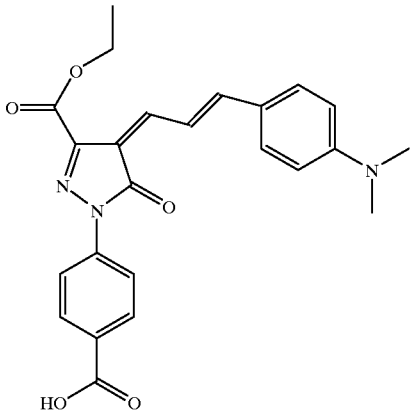

DYE 6

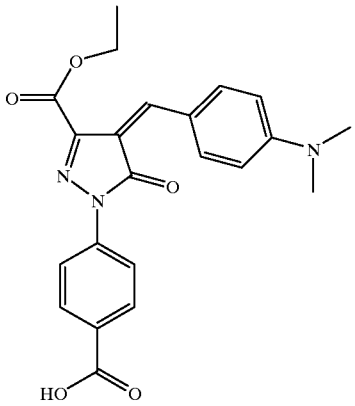

In the practice of the invention, the solid dye may be subjected to a pulverization process (such as bead milling) in the presence of a glycerophospholipid dispersant and an aqueous medium, preferably buffered in the pH range 5.0 to 6.5, until the particle size distribution is such that at least 90% of the particles are of 1.0 mm size or less, and preferably until at least 90% of the particles are of 0.5 mm size or less. The resulting dispersion is then filtered (optionally after dilution with water or buffer solution) to remove the beads or other milling media, and if necessary to remove any residual aggregates or large particles. However, it is typically found that no large particles or aggregates remain, even after relatively short milling times, and only coarse filtration is required. For photographic use, the dispersion is typically mixed with gelatin solution, along with hardener(s) and surfactant(s) as necessary, with a view to coating as a component layer of a photographic element.

Two key factors in the production of a solid particle dispersion are (a) the suppression of foaming and/or bubble entrainment, and (b) the stability of the resulting dispersion towards settling and re-aggregation. It is surprisingly found that glycerophospholipid dispersants, such as lecithin, provide an improvement in both these aspects. In particular, the suppression of foam and bubble formation is particularly noticeable. Because of the reduced tendency for foaming, vigorous milling conditions can safely be employed, with the result that milling times may be reduced substantially when glycerophospholipid dispersants, such as lecithin are present, compared with the surfactants or milling aids disclosed in the prior art. Furthermore, the resulting dispersions show no tendency for settling or aggregation when stored for extended periods.

Any conventional milling apparatus may be used. Such apparatus typically causes mechanical attrition of a solid material by agitation in the presence of a milling medium. The milling medium normally takes the form of beads of a hard, inert material, e.g., of diameter 1 to 5 mm. Provided it is sufficiently hard and is chemically inert towards the components of the dispersion, there is no particular restriction on the identity of the milling medium. Both organic materials, such as the polymers disclosed in U.S. Pat. No. 5,478,705, and inorganic materials, such as silica or zirconia, are suitable. Examples of suitable milling apparatus include roller mills, pearl mills, bead mills, sand mills, etc. In the milling process, the relative quantities of aqueous medium, dye and milling medium may vary widely, depending on factors such as the bead size of the milling medium, and the loading of dye required. Generally, it is more efficient to mill the dye to the desired particle size at a relatively high concentration and then dilute it to the desired level with aqueous buffer and/or gelatin solution. For milling media of about 1 mm bead size, the volume ratio of aqueous medium to milling medium is typically in the range 1:2 to 2:1, and the weight ratio of dye to aqueous medium is typically in the range 1:5 to 1:50, preferably in the range 1:10 to 1:30.

At the end of the milling process, the dispersion is separated from the milling media by filtration through a relatively coarse screen which retains the beads but allows the dispersed dye particles to pass through. Muslin is a suitable material for this purpose. For photographic use, the resulting solid particle dye dispersions are diluted with aqueous solutions of gelatin (optionally blended with other hydrophillic colloids) then coated as a layer of a photographic element. The degree of dilution, and concentration of gelatin used, depend on the optical density and layer thickness desired. Weight ratios of gelatin to dye are typically in the range 1:4 to 50:1, preferably 5:1 to 25:1. Essentially any type of gelatin of photographic grade may be used.

Solid particle dye dispersions in accordance with the invention find particular use as filtering layers in photographic elements, where it is essential that the dyes be strictly confined to their intended layer(s) during coating and storage, but be completely removed during processing. For example, in conventional color negative film, a yellow filter layer is normally interposed between the outer blue-sensitive emulsion layer(s) and the inner green- and red-sensitive emulsion layers in the interests of improved color separation. A solid particle dye dispersion in accordance with the invention, comprising one or more dyes absorbing in the near-UV/blue region, may be used advantageously for this purpose, e.g., providing an optical density of about 0.2 to 0.7 in the wavelength range 350 to 450 nm.

Many types of photographic element incorporate an antihalation layer between the base and the emulsion layer(s) for the purpose of absorbing radiation that has passed through the emulsion layer(s) and which may otherwise reflect from the base and expose adjacent areas of the emulsion and hence cause image spread. Solid particle dye dispersions in accordance with the invention are particularly suitable for this purpose, the dyes being selected so as to provide an absorption profile matching the spectral sensitivity of the overlying emulsion(s), or alternatively matching the spectral output of the exposing source if it is a narrow band source, such as a laser. An optical density of about 0.1 to 0.6 at the wavelength of maximum absorption is typically required. A particularly important use for solid particle dye dispersions in accordance with the invention is as anticrossover layers in radiographic elements, especially medical X-ray films. Such materials normally comprise a transparent film base coated on both sides with silver halide emulsions, and are exposed by means of phosphor screens placed either side of the film, in close proximity to the emulsion layers. The phosphor screens emit light (at wavelengths to which the emulsion layers are sensitized) in response to X-ray irradiation. A well-known problem with such systems is that of crossover, whereby light emitted by either of the screens is not fully absorbed by the adjacent emulsion layer, but passes through the base and exposes the remote emulsion layer. While this makes efficient use of the available light, and hence increases speed, it also degrades the image sharpness to a significant degree, and so it is normally considered desirable to limit the degree of crossover, and in some circumstances to eliminate it altogether (such as in asymmetric films, in which different emulsions are coated on the separate sides of the base, and are matched to particular screens). Solid particle dye dispersions, coated as underlayers between the base and the emulsion layers, provide an effective solution. By selecting dyes which absorb at the appropriate wavelengths, and adjusting their concentration in the layer and/or the thickness, it is possible to reduce the degree of crossover to the desired level. Two relatively thin dye underlayers may be provided (one on either side of the base), or a single, relatively thick, dye underlayer may be provided on one side only. The use of two thin layers is preferable as it facilitates the bleaching/wash out of the dyes during processing, and also enables the gelatin coating weights on the two sided to be balanced. The optimum optical density provided by the dye underlayer(s) depends on a number of factors, notably the degree of crossover reduction required, and the extent of overlap between the absorption spectrum of the dye(s) and the emission spectrum of the screens. As an illustration, using dyes that are well matched to the screen output, an optical density of about 0.3 (i.e., about 0.15 on either side), is sufficient to reduce crossover from about 22% to about 17%.

In the manufacture of photographic elements in accordance with the invention, the methods and materials (other than the dye dispersions themselves) are entirely conventional. Thus the emulsion layers may be prepared and coated without the need for special modifications to accommodate the layers comprising the solid dye dispersions. Any of the conventional coating techniques may be employed for the coating of the dye containing layers, including gravure coating, slot coating, curtain coating, etc.

The invention will now be illustrated by the following Examples.

EXAMPLES

The following is a glossary of abbreviations, trade names etc. used in the examples.

Lecithin—soybean lecithin supplied by Stern (under the trade name Centrolex-P)

Triton™ X-100—nonionic surfactant (octoxynol-9) supplied by Union Carbide

Triton™ X-200—anionic surfactant (sodium octoxynol-2-ethanesulfonate) supplied by Union Carbide Alkanol™ XC—anionic surfactant (sodium alkylnaphthalene sulfonate) supplied by Du Pont Surfynol™ CT136—surfactant blend supplied by Air Products and Chemicals as a wetting agent, defoamer, grind aid and dispersant for water- and glycol-based inks and pigments Dyapol™ WB-LS—anionic surfactant (naphthalene sulfonate based) supplied by Yorkshire Chemicals, Leeds U.K.

Hydrion™—buffer composition supplied by Aldrich

Dyes 1 to 6 referred to above were prepared by published methods or simple adaptations thereof. (For Dyes 1 and 3, see U.S. Pat. No. 5,326,687; for Dyes 5 and 6, see EP 0274723; for Dye 2, see U.S. Pat. No. 3,560,214; and for Dye 4, see U.S. Pat. No. 3,985,565, col. 5.)

Example 1

This Example demonstrates the non-foaming characteristics of lecithin in comparison to a variety of other surfactant and dispersing agents in aqueous systems.

Samples of various aqueous mixtures were stirred for 1 minute at various speeds using a vertical sawtooth stirring device of 4 cm diameter in a cylindrical vessel of height 12 cm and internal diameter 10 cm. The height of the liquid in the vessel was recorded prior to stirring commencing, after stirring for 1 minute, and 5 minutes after stirring had ceased. Comparison of these figures for a particular solution gave an indication of the degree of foaming and its persistence. The appearance of the bulk liquid was also checked for the presence of bubbles.

The results are summarized in Table 1, which records the change in height (in cm) observed when the various aqueous compositions were stirred at the indicated rpm, the heights being measured after 1 minute of stirring and 5 minutes after cessation of stirring. In Table 1, "phthalate" refers to a conventional phthalate buffer of pH 5.0, and Hydrion™ to the commercially available buffer of pH 5.0. Neither pure water nor the buffer solutions gave rise to foam in the absence of surfactants or dispersing agents, but the addition of Triton™ X-200 caused severe and persistent foaming in all cases, but to a slightly lesser extent in the Hydrion™ buffer. This buffer was therefore tested with further surfactants and dispersants, but although lecithin, Dyapol™ WB-LS and Surfynol™ CT136 all showed good non-foaming characteristics, only the lecithin solutions remained free from bubble entrapment.

TABLE 1

| | | Height Increase (cm) after stirring at indicated rpm | | | | | | | |
|---|---|---|---|---|---|---|---|---|---|
| Solution | Test* | 1000 | 2000 | 3000 | 4000 | 5000 | 6000 | 7000 | 8000 |
| Comparative | (a) | nil | nil | nil | nil | nil | nil | nil | nil |
| Water | (b) | nil | nil | nil | nil | nil | nil | nil | nil |
| Hydrion ™ | (a) | nil | nil | nil | nil | nil | nil | nil | nil |
| | (b) | nil | nil | nil | nil | nil | nil | nil | nil |
| Phthalate | (a) | nil | nil | nil | nil | nil | nil | nil | nil |
| | (b) | nil | nil | nil | nil | nil | nil | nil | nil |
| Water + Triton ™ | (a) | 1.5 | 3.5 | 4.5 | 6 | 8.5 | 10 | 10 | 11 |
| X-200 (0.4% w/v) | (b) | 1 | 3 | 4.5 | 5.5 | 8 | 8 | 9 | 10 |
| Hydrion ™ + | (a) | 2 | 2 | 3 | 5 | 8 | 9.5 | 10 | 11 |
| Triton ™ X-200 | (b) | 2 | 2 | 3 | 4.5 | 7 | 8 | 9 | 10 |
| (0.4% w/v) | | | | | | | | | |
| Phthalate + | (a) | 2 | 4.5 | 6 | 8 | 8.5 | 8.5 | 10 | 10 |
| Triton ™ X200 | (b) | 2 | 4.5 | 6 | 8 | 8.5 | 8 | 8 | 8 |
| (0.4% w/v) | | | | | | | | | |
| Hydrion ™ + | (a) | 1 | 2 | 3 | 3 | 4.5 | 5.5 | 3.5 | 3.5 |
| Triton ™ X-100 | (b) | nil | 1.5 | 2 | 3.5 | 4 | 5 | 2.5 | 3 |
| (0.4% w/v) | | | | | | | | | |
| Hydrion ™ + | (a) | 2 | 3 | 3.5 | 4 | 5 | — | — | — |
| Alkanol ™ XC | (b) | 2 | 2.5 | 2.5 | 3.5 | — | — | — | — |
| (0.4% w/v) | | | | | | | | | |
| Hydrion ™ + | (a) | 2.5 | 2.5 | 2 | 1.5 | 2 | 1 | 1 | 1 |
| Surfynol ™ CT136 | (b)** | 0.5 | 0.5 | 0.5 | 0.5 | 0.5 | 0.5 | 0.5 | nil |
| (2.7% w/v) | | | | | | | | | |
| Hydrion ™ + | (a) | nil | nil | nil | nil | nil | nil | nil | nil |
| Dyapol ™ WB-LS | (b)** | nil | nil | nil | nil | nil | nil | nil | nil |
| (0.4% w/v) | | | | | | | | | |
| Invention | (a) | 1 | 0.5 | 0.5 | nil | nil | nil | nil | nil |
| Hydrion ™ + | (b) | 1 | 0.5 | 0.5 | nil | nil | nil | nil | nil |
| lecithin (0.46% w/v) | | | | | | | | | |
| Hydrion ™ + | (a) | nil | nil | nil | nil | nil | nil | nil | nil |
| lecithin (0.92% w/v) | (b) | nil | nil | nil | nil | nil | nil | nil | nil |

*(a) 1 min stirring at indicated rpm
(b) 1 min stirring + 5 mins rest
**bubbles present in bulk liquid Example 2

Dye Dispersions

Samples of dyes 1 to 5 were milled using zirconia beads (1–2 mm) in a Dispermat CV vertical shaft milling machine running at 2000 rpm, in the presence of Hydrion buffer and lecithin as dispersing aid. As a comparison, a sample of dye 1 was similarly milled, but with Triton X-200 substituted for lecithin, and with addition of amyl alcohol as a foam suppressant. The results are summarized in Table 2.

TABLE 2

| | Sample 1(c) | Sample 2 | Sample 3 | Sample 4 | Sample 5 | Sample 6 | Sample 7 |
|---|---|---|---|---|---|---|---|
| Hydrion buffer (ml) | 108 | 108 | 108 | 108 | 136 | 70 | 69 |
| ZrO beads (ml) | 120 | 120 | 120 | 120 | 86 | 35 | 69 |
| Dye 1 (g) | 20 | 20 | — | — | — | — | — |
| Dye 2 (g) | — | — | 20 | 20 | — | — | — |
| Dye 3 (g) | — | — | — | — | 8 | — | — |
| Dye 4 (g) | — | — | — | — | — | 3.2 | — |
| Dye 5 (g) | — | — | — | — | — | — | 6.4 |
| Triton ™ X-200 (4%) (ml) | 12 | — | — | — | — | — | — |
| Amyl alcohol (ml) | 3.5 | — | — | — | — | — | — |
| Lecithin (g) | — | 1.2 | 1.0 | 1.5 | 0.4 | 0.16 | 0.32 |
| Particle size* (mm) | 1.0 | 1.0 | 1.0 | 0.5 | 2.0 | 2.0 | 1.0 |
| Milling time (hours) | 18 | 7 | 7 | 24 | 21 | 38 | 18 |

*90% of particles smaller than this.
(c) = comparison, not in accordance with the invention.

Samples 2 to 7 formed stable dispersions, with no foaming or bubble entrapment, whereas Sample 1 (comparative) gave considerable foam, and required 2 to 3 times longer milling compared to Sample 2 to achieve equivalent particle size reduction.

Example 3

Milling Regime

Samples of Dye 1 and Dye 6 were milled in the presence of lecithin and buffer solution in a Dispermat SL horizontal bead mill using zirconia beads (1–2 mm diameter). Milling was performed at 3000–4500 rpm with recirculation. Under these conditions, Triton X-200 caused excessive foam build-up, and did not give usable dispersions, even with amyl alcohol present as foam suppressant. All samples in accordance with the invention milled smoothly and without foaming problems. Details are summarized in Table 3:

TABLE 3

| | Sample 8 | Sample 9 | Sample 10 | Sample 11 |
|---|---|---|---|---|
| Hydrion buffer (ml) | 108 | 108 | 108 | 108 |
| Zr0 beads (ml) | 220 | 220 | 220 | 220 |
| Dye 1 (g) | 30 | 30 | 30 | — |
| Dye 6 (g) | — | — | — | 30 |
| Lecithin (g) | 1.5 | 1.0 | 1.5 | 0.5 |
| Mill rpm | 3000 | 4500 | 4500 | 4500 |
| Particle size (mm)* | 1.0 | 1.0 | 0.5 | 1.0 |
| Milling time (hours) | 7 | 7 | 15 | 7 |

*90% of particles smaller than this figure.

Example 4

Anticrossover Layer for Double Sided Radiographic Elements

To a mill container of 1 liter capacity was charged solid lecithin (0.5 g), Dye 2 (10 g), pH 5.0 buffer (220 ml) and zirconia beads (1–2 mm diameter, 220 ml), and the mixture agitated at 2000 rpm for 24 hours on a Dispermat CV vertical shaft mill. The mixture was diluted with a further 200 ml buffer while agitation at 1000 rpm continued. Thereafter, the zirconia beads were removed by filtration through a muslin membrane, and the dye dispersion added at a rate of 20 ml/min to a warm gelatin solution (5% w/v) containing Triton X-200 (1 ml of 10% solution per 10 g gelatin used), with stirring at 500 rpm via a Silversen stirrer. The gelatin: dye ratio at this stage was 4.5:1. Samples of the resulting dispersion were added to further quantities of 5% gelatin solution with stirring as before, giving a series of dispersions with gelatin: dye ratios in the range 4.5:1 to 25:1, with 90% of the particles less than 0.4 mm in size.

The dispersions were diluted to the required viscosity for coating and adjusted to pH 5.3, then coated at a gelatin coating weight of 0.6 g/m$^2$ per side on both sides of a transparent polyester film giving combined transmission optical densities in the green in the range 0.2 to 0.6. A green sensitized tabular silver bromide emulsion and a gelatin topcoat (both at pH 6.0) were then coated on top of the dye layers. The tabular silver bromide emulsion was prepared by the method described in U.S. Pat. No. 5,028,521, chemically- and spectrally-sensitized by conventional methods, and coated at approximately 2.0 g/m$^2$ silver per side.

Samples of the resulting photographic films were exposed sensitometrically by conventional methods, processed in Kodak RA chemistry, and the normal sensitometric parameters (Dmin, Dmax, speed and contrast) were recorded. The degree of crossover was measured by the method described in U.S. Pat. No. 4,803,150. A comparative Sample (c) lacking the dye underlayers was subjected to the same analysis. Representative results are summarized in Table 4:

TABLE 4

| Sample | OD of dye layers | Dmax | Dmin | Speed | Contrast | Crossover |
|---|---|---|---|---|---|---|
| (c) | — | 3.59 | 0.19 | 0.96 | 2.85 | 24% |
| 12 | 0.28 | 3.35 | 0.19 | 0.82 | 2.72 | 17% |
| 13 | 0.60 | 3.28 | 0.19 | 0.77 | 2.60 | 10% |

Variations in Dmax and contrast were consistent with variations in silver coating weight and degree of hardening. The percentage crossover decreased with increasing dye layer optical density, in accordance with expectations, with a concomitant loss of speed. The magnitude of the speed loss was consistent with the reduction in crossover, and there was no indication of desensitization of the emulsion due to migration of the dye. Most importantly, there was no increase in Dmin, even for the highest loading of dye, showing that complete removal of the dye was possible even in a rapid processing cycle.

Accelerated aging studies revealed no detrimental effects from the dye underlayers on the long term stability.

The words TRITON X-200, STERNPUR PM, STERNPUR E, CENTROLEX P, LECITHIN, TRITON X-100 ALKANOL XC, SURFYNOL CT136, DYAPOL WB-LS and HYDRION are registered trademarks.

What is claimed is:

1. A method of forming a dispersion of solid particles of a dye in a gelatin medium comprising:

(a) milling said solid particles of said dye in an aqueous medium comprising a glycerophospholipid dispersant to yield a dispersion; and (b) diluting the resulting dispersion with an aqueous solution containing a gelatin, wherein said aqueous medium is buffered to a pH in the range 5.0 to 6.5.

2. The method of claim 1 wherein said glycerophospholipid dispersant comprises at least one compound of structural formula:

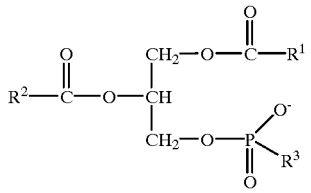

wherein:

$R^1$ and $R^2$ independently represent alkyl or alkene groups of at least 6 carbon atoms; and $R^3$ represents a quaternized aminoalkoxy group.

3. The method of claim 1 wherein said dye is selected from the group consisting of

DYE 1

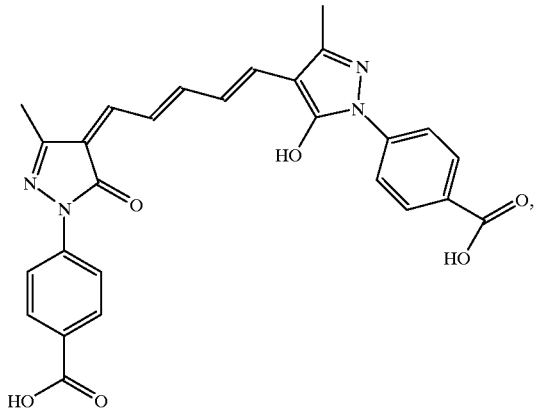

DYE 2

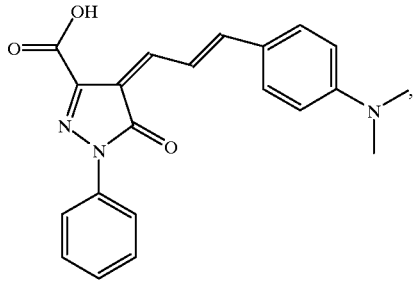

DYE 3

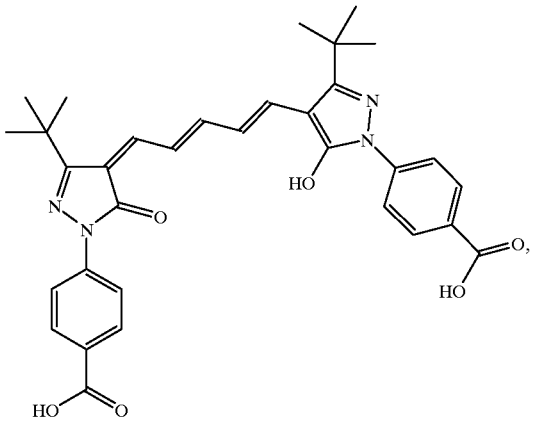

-continued

DYE 4

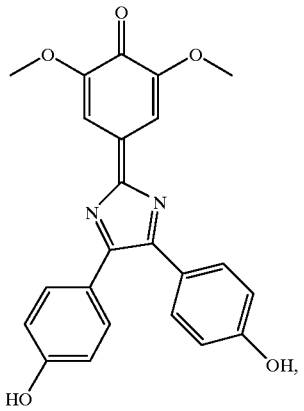

DYE 5

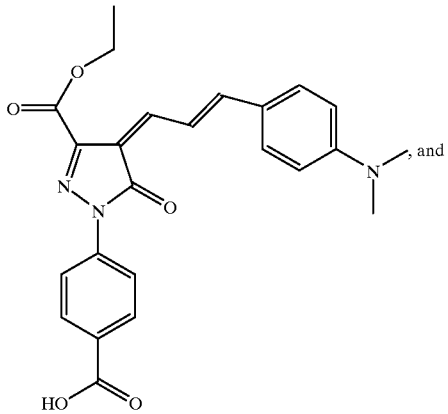

DYE 6

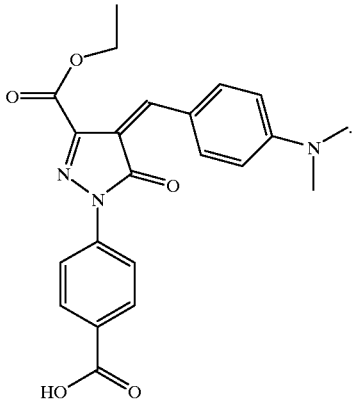

4. The method of claim 1 wherein said glycerophospholipid dispersant is present in an amount from 1 to 10% by weight of the weight of said dye.

5. The method of claim 1 wherein beads of hard, inert material are used as a milling medium during said milling step.

6. The method of claim 1 wherein the volume ratio of said aqueous medium to said milling medium is in the range 1:2 to 2:1.

7. The method of claim 1 wherein the weight ratio of said dye to said aqueous medium is in the range 1:5 to 1:50.

8. The method of claim 1 wherein the weight ratio of said dye to said aqueous medium is in the range 1:10 to 1:30.

9. The method of claim 1 wherein the weight ratio of said gelatin to said dye is in the range 1:4 to 50:1.

10. The method of claim 1 wherein the weight ratio of said gelatin to said dye is in the range 5:1 to 25:1.

11. A photographic material comprising a support having coated thereon at least one silver halide emulsion layer and at least one hydrophillic colloid layer comprising a dispersion of a dye and a glycerophospholipid dispersant, wherein said dispersion of said dye is prepared according to the method of claim 1.

12. The method of claim 1 wherein the dispersion has reduced foaming and/or bubble entrainment compared to a dispersion without the glycerophospholipid dispersant.

13. The photographic material of claim 11 wherein said hydrophillic colloid layer is coated as an antihalation layer between said support and said silver halide emulsion layer.

14. The photographic material of claim 11 wherein said photographic material is an X-ray film and said hydrophillic colloid layer is coated on either side of said support and overcoated with said silver halide emulsion layer.

15. A method of preparing a photographic material comprising coating a support with at least one silver halide emulsion layer and at least one additional hydrophillic colloid layer comprising a dispersion prepared by (a) milling solid particles of a dye in an aqueous medium comprising a glycerophospholipid dispersant to yield a dispersion; and (b) diluting the resulting dispersion with an aqueous solution containing a gelatin, wherein said aqueous medium is buffered to a pH in the range 5.0 to 6.5.

16. The method of claim 15 wherein said additional hydrophillic colloid layer is coated as an antihalation layer between said support and said silver halide emulsion layer.

17. A method of claim 15 wherein said photographic material is an X-ray film and one of said additional hydrophillic colloid layers is coated on at least one side of said support and overcoated with said silver halide emulsion layer.

18. The method of claim 15 wherein the dispersion has reduced foaming and/or bubble entrainment compared to a dispersion without the glycerophospholipid dispersant.

* * * * *

UNITED STATES PATENT AND TRADEMARK OFFICE

CERTIFICATE OF CORRECTION

PATENT NO. : 6,045,986
DATED : April 4, 2000
INVENTOR(S) : Philip I. Mayo, Valerie Millar and Mark P. Kirk It is certified that error appears in the above-identified patent and that said Letters Patent is hereby corrected as shown below:

Title page,
In the Assignee area [73], please replace "Commerial" with -- Comercial --

Signed and Sealed this

Seventh Day of May, 2002

*Attest:*

*Attesting Officer*

JAMES E. ROGAN
*Director of the United States Patent and Trademark Office*